US012678650B2

(12) United States Patent
Passamonte

(10) Patent No.: US 12,678,650 B2
(45) Date of Patent: Jul. 14, 2026

(54) GRASPABLE EXERCISER

(71) Applicant: Luigi Passamonte, Paratico (IT)

(72) Inventor: Luigi Passamonte, Paratico (IT)

(73) Assignee: Luìgi Passamonte, Paratico (IT)

( * ) Notice: Subject to any disclaimer, the term of this patent is extended or adjusted under 35 U.S.C. 154(b) by 109 days.

(21) Appl. No.: 18/908,038

(22) Filed: Oct. 7, 2024

(65) Prior Publication Data

US 2025/0114655 A1 Apr. 10, 2025

(30) Foreign Application Priority Data

Oct. 9, 2023 (IT) ..... 102023000020961

(51) Int. Cl.
*A63B 21/06* (2006.01)
*A63B 21/00* (2006.01)

(52) U.S. Cl.
CPC ..... *A63B 21/0609* (2013.01); *A63B 21/0604* (2013.01); *A63B 21/4035* (2015.10)

(58) Field of Classification Search
CPC ..... A63B 21/0004; A63B 21/00065; A63B 21/04; A63B 21/0435; A63B 21/0442; A63B 21/055; A63B 21/0552; A63B 21/0557; A63B 21/0604; A63B 21/0609; A63B 21/072; A63B 21/075; A63B 21/08; A63B 21/4023; A63B 21/4035; A63B 21/4043; A63B 2209/00; A63B 2244/09
See application file for complete search history.

(56) References Cited

U.S. PATENT DOCUMENTS

| | | | | |
|---|---|---|---|---|
| 410,778 | A * | 9/1889 | Bidwell | A63B 21/0552 482/125 |
| 7,727,131 | B2 * | 6/2010 | Longo | A63B 21/0552 482/121 |
| 9,486,663 | B2 * | 11/2016 | DeMarco | A63B 21/16 |
| 10,252,105 | B2 | 4/2019 | Dickens | |
| 10,434,358 | B2 | 10/2019 | Chen | |
| 2004/0147378 | A1 * | 7/2004 | Conklin | A63B 21/169 482/124 |
| 2006/0048719 | A1 * | 3/2006 | Myers | A01K 15/026 119/710 |
| 2014/0073496 | A1 | 3/2014 | Bannerman | |
| 2016/0121157 | A1 | 5/2016 | Belmore | |
| 2019/0201732 | A1 * | 7/2019 | Chang | A63B 21/0557 |
| 2021/0162254 | A1 * | 6/2021 | Bettini | A63B 21/151 |
| 2021/0283459 | A1 * | 9/2021 | Ozeki | A63B 21/151 |
| 2024/0001188 | A1 * | 1/2024 | Hirabayashi | A63B 21/04 |
| 2024/0189649 | A1 * | 6/2024 | Wong | A63B 21/4035 |

FOREIGN PATENT DOCUMENTS

IT 102023000020961 B1 * 10/2025

OTHER PUBLICATIONS

Search Report for IT 2023000209618, mailed Apr. 4, 2024.

* cited by examiner

*Primary Examiner* — Gary D Urbiel Goldner
(74) *Attorney, Agent, or Firm* — Ferguson Case Orr Paterson

(57) ABSTRACT

An exerciser graspable by a user for performing a physical exercise is provided. The exerciser has a ring extending about a device axis, and at least one ballast element having a linear extension along a main axis between a connection portion and a final end distal from the device axis. Each ballast element is freely connected to the ring by the connection portion, allowing the ballast element to freely perform relative movements with respect to the ring, even without an intervention of the user.

13 Claims, 3 Drawing Sheets

GRASPABLE EXERCISER

CROSS-REFERENCE TO RELATED APPLICATION

This application claims priority to Italian Patent Application No. 102023000020961 filed Oct. 9, 2023, the contents of which is hereby incorporated in its entirety by reference.

FIELD OF THE INVENTION

The present invention relates to the field of physical and sports activities, and more generally activities aimed at training the body of a user. Specifically, the present invention relates to the field of exercisers for physical exercises for training the human body.

BACKGROUND OF THE INVENTION

In the field of sports and physical activities, several tools usable by a user in the context of physical activities are known. For example, for overload training conventionally practiced in weight rooms, KETTLBELLS® are nowadays very popular, i.e., exercisers acting as a counterweight, consisting of a main body, mainly spherical and having a predefined mass, and a handle graspable by the user.

The strength of exercisers such as the latter lies in the versatility of use in several sports disciplines, as well as in the possibility of being used by all types of users, whether beginners or experienced.

Modern exercisers, in fact, must have features like these to meet the most varied needs of the world of fitness, increasingly driven by the constant search for new types of training and by the need to customize exercises based on the user's profile. In such a sense, one of the key points for the success of exercisers lies in the multifunctionality and multidisciplinarity offered to the user.

At the same time, such exercisers must be simple to use, allowing an intuitive approach to training, even for less experienced users.

It is also required that such exercisers be modular and easy to assemble.

This field requires that new exercisers be economically affordable to produce.

Finally, a certain degree of aesthetics is required, so as to be appealing to the eyes of a user who wants to use the exerciser.

SUMMARY OF THE INVENTION

It is the object of the present invention to create an exerciser for the multifunctional training of the human body which meets one or more of the needs of the field and of the users, with particular reference to the attractive aesthetic appearance, ease of use and assembly, versatility, modularity and cost-effectiveness of the exerciser.

These and other objects are achieved by an exerciser as described and claimed herein. Advantageous embodiments are also described.

BRIEF DESCRIPTION OF THE FIGURES

The features and advantages of the exerciser according to the present invention will become apparent from the following description, given by way of non-limiting example, according to the accompanying drawings, in which.

DETAILED DESCRIPTION

Figure 1:
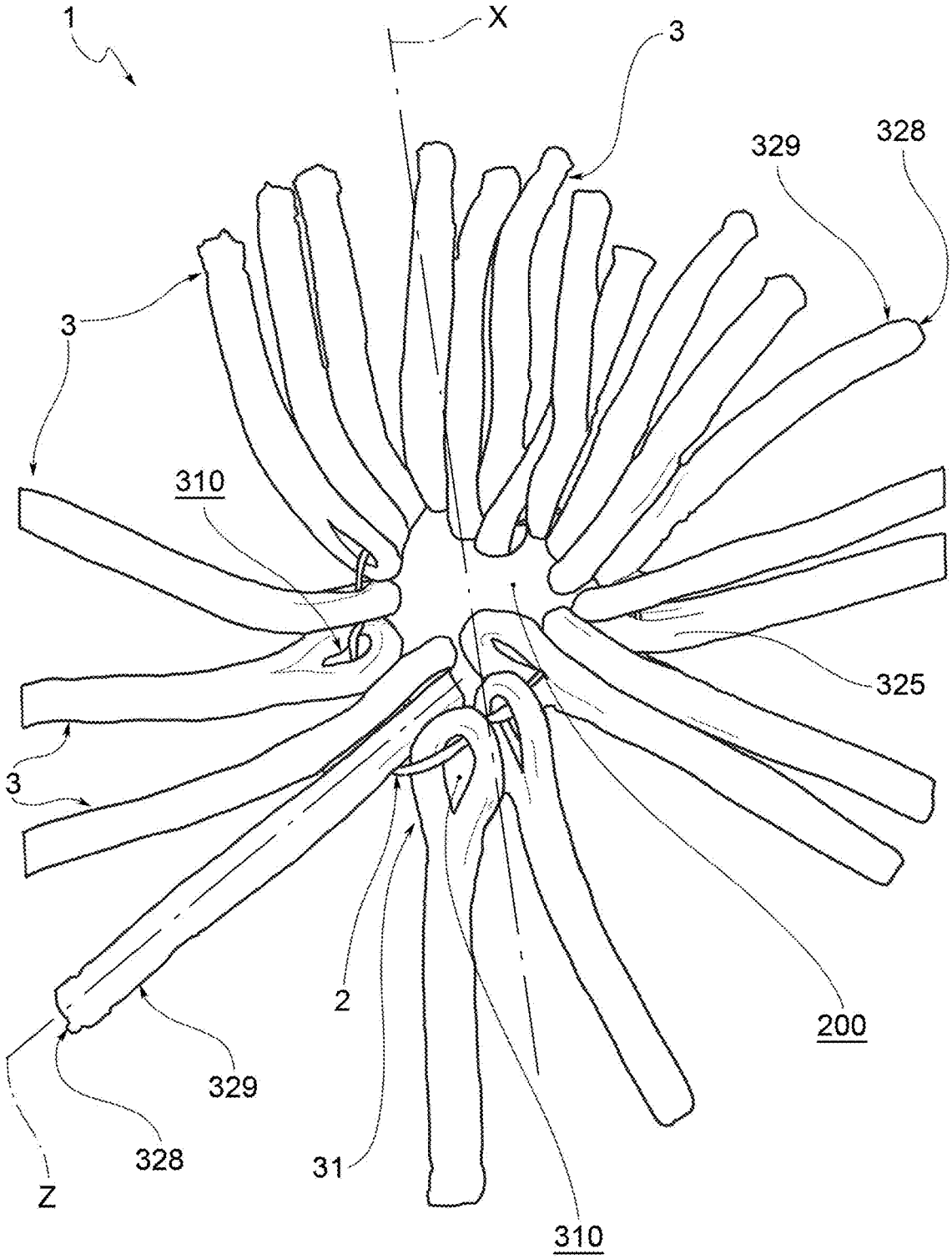
FIG. 1 shows an exerciser, according to an embodiment of the present invention.
Figure 2:
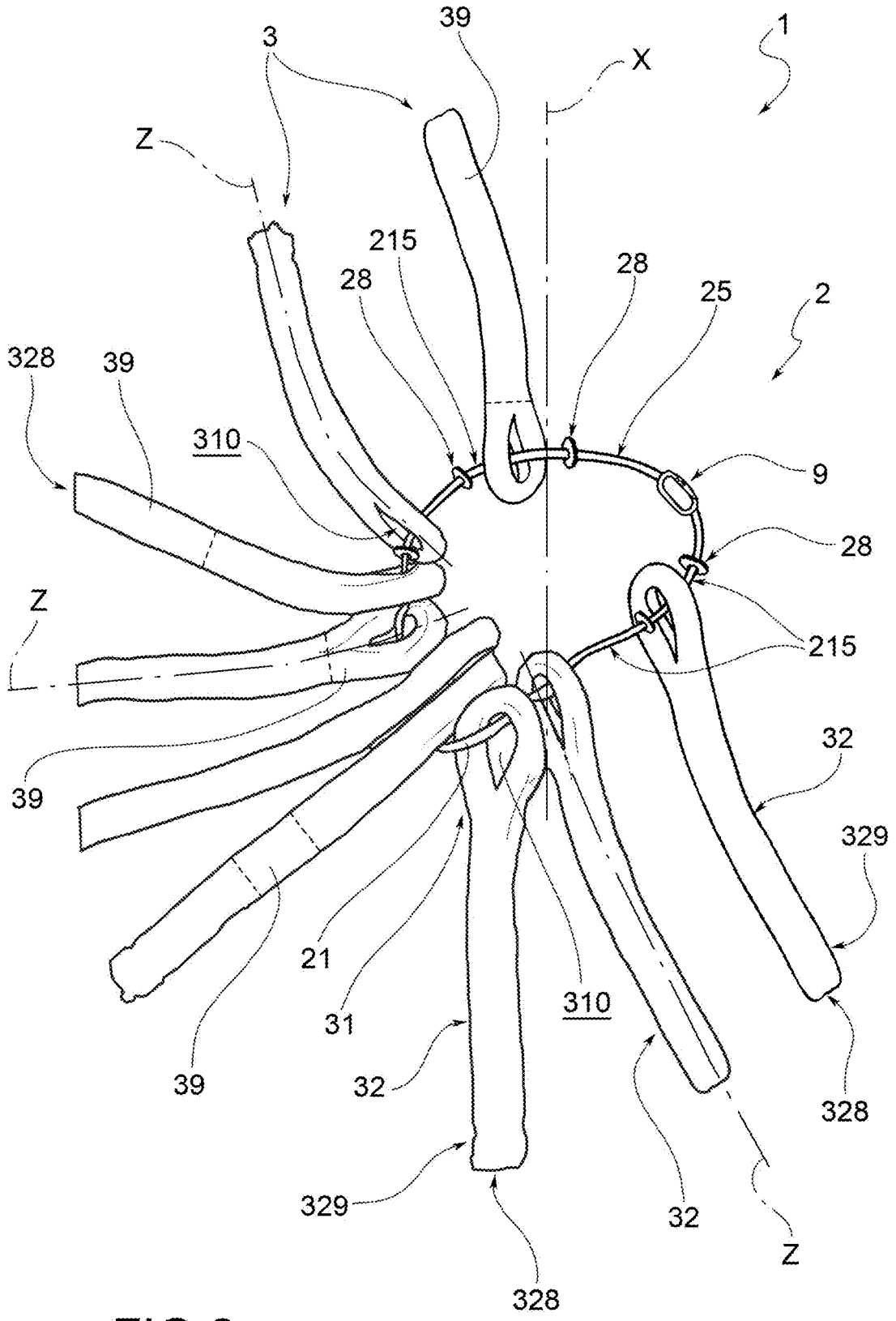
FIG. 2 shows an exerciser, according to an embodiment of the present invention.
Figure 3:
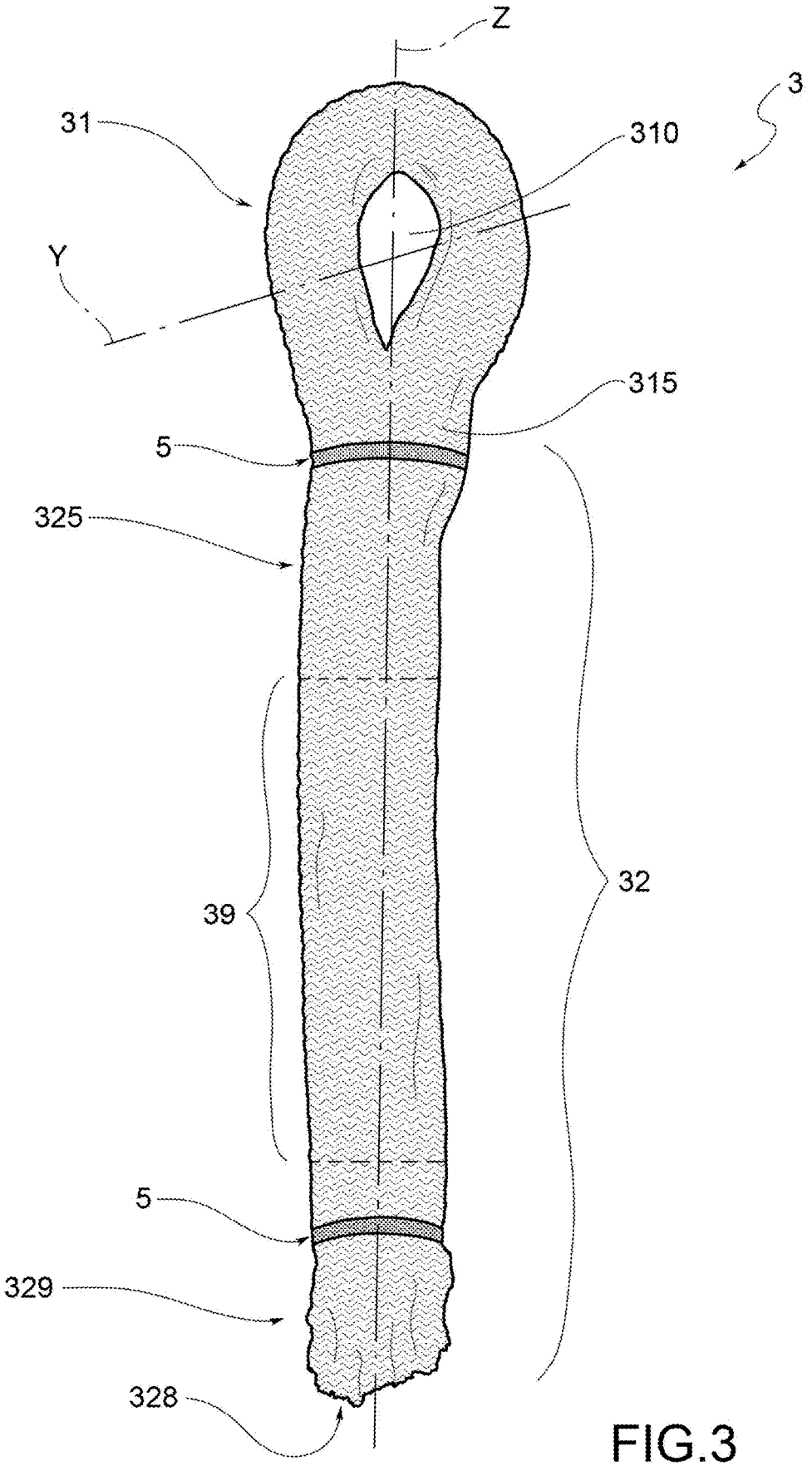
FIG. 3 shows a ballast element of an exerciser, according to an embodiment of the present invention.

With reference to the Figures of the accompanying drawings, numeral 1 indicates as a whole an exerciser graspable by a user to perform a physical exercise, aimed at training the body of the user.

The exerciser 1 comprises an annular device 2 having a device axis X and comprising a ring 21 extending about the device axis X.

In one embodiment, with respect to the device axis X, the ring 21 is annular or tubular in shape.

In one embodiment, with respect to the device axis X, the ring 21 has a small or thin dimension in the radial direction and/or in the axial direction.

In one embodiment, the ring 21 has a circular cross-section and a diameter between 1 and 15 centimeters, preferably between 2 and 10 centimeters, for example of about 7 centimeters.

In one embodiment, the ring 21 peripherally defines a joining area 200 therein, for example having a circular shape on a plane orthogonal to the device axis X.

In one embodiment, the annular device 2 is configurable in a plurality of configurations, in each of which the ring 21 has a predefined dimension with respect to the device axis X.

Preferably, the ring 21 has an adjustable circumferential length and/or an adjustable diameter.

In one embodiment, the ring 21 is wearable on the body or parts of the body of the user, for example it is wearable on the torso or a shoulder or an arm or a leg or the waist of the user.

In one embodiment, the ring 21 consists of one or more of: a ring, a cord or rope, a thread, a band, a belt, a strap, a chain.

In one embodiment, the ring 21 is made of a material belonging to the family of plastic materials.

In one embodiment, the ring 21 is made of rubber.

In one embodiment, the ring 21 is at least partially or completely elastically deformable.

In one embodiment, the ring 21 is designed to be elastically non-deformable.

In one embodiment, the ring 21 extends continuously about the device axis X creating a closed path, for example it is in the shape of a closed ring.

In one embodiment, the ring 21 is divided into segments 215 which are distinct from one another and spaced apart in a circumferential direction about the device axis X, and are operatively connected to one another, to create a closed path.

In one embodiment, the annular device 2 comprises one or more end-of-stroke devices 28 interspersed and distributed circumferentially about the device axis X, separating two adjacent segments 215 of the ring 21.

Preferably, the one or more end-of-stroke devices 28 are slidingly engaged with the ring 21 and positionable in a plurality of angular positions about the device axis X.

In one embodiment, at least one segment 215 of the ring 21 is manually graspable by a user to perform the physical exercise.

In one embodiment, the ring 21 has a circular cross-section and a diameter between 1 and 15 centimeters, preferably between 2 and 10 centimeters, for example of about 7 centimeters. Such dimensions allow the ring to be correctly graspable for performing the physical exercises. Larger dimensions do not allow for an adequate grip, making it difficult to perform physical exercises.

The exerciser 1 comprises at least one ballast element 3 constrained to the annular device 2.

Preferably, the exerciser 1 comprises at least two ballast elements 3 constrained to each other by means of the annular device 2.

Preferably, the exerciser 1 comprises a plurality of ballast elements 3 constrained to each other by means of the annular device 2.

Each ballast element 3 extends linearly along a main axis Z.

Each ballast element 3 has a predefined mass.

In one embodiment, the ballast elements 3 have the same mass, for example they all have a mass of about 1 kilogram.

In one embodiment, the ballast elements 3 have mutually different masses. Preferably, each ballast element 3 has a predefined mass, preferably where each mass is between 0.5 and 10 kilograms, preferably between 1 and 5 kilograms.

The ballast element 3 or the plurality of ballast elements 3 has an overload function to perform the physical exercise.

In a preferred embodiment, the ballast element 3 is mechanically engaged with a segment 215 of the ring 21, for example is positioned between two end-of-stroke devices 28 which partially limit or prevent the movement thereof along the ring 21.

Each ballast element 3 comprises a connection portion 31 mechanically connected to the ring 21, for example to a segment 215 of the ring 21.

In other words, by means of the ring 21, the ballast elements 3 are operatively connected together.

In a preferred embodiment, except for the common constraint created by the ring 21, the ballast elements 3 are independent of each other.

In other words, except for the common constraint created by the ring 21, each ballast element 3 allows the free movement of another ballast element 3. In further other words, except for the common constraint created by the ring 21, each ballast element 3 has no mechanical connection with another ballast element 3.

The connection of the ballast element 3 to the ring 21 is free, thus allowing a movement of universal type of the ballast element 3 with respect to the ring 21 in the absence of the user's support.

A movement of universal type of the ballast element 3 with respect to the ring 21 in the absence of the user's support means that the ballast element 3 is free to perform relative movements with respect to the ring 21, even without the intervention of the user. For example, the ballast element 3 is free to move with respect to the ring 21 due to the force of gravity. For example, with a first ballast element 3 grasped by the user and brought to a first distance from the ground, the connection with the ring 21 allows the second ballast element 3 to position itself, for example due to the force of gravity, at an equilibrium point along the ring 21 at a second distance from the ground being shorter than the predefined first distance from the ground of the first ballast element 3.

In one embodiment, the ballast element 3 comprises a connection opening 310 in the connection portion 31. The ring 21, for example a segment 215 of the ring 21, passes through the connection opening 310 of the ballast element 3.

In one embodiment, the connection opening 310 is a slot having a predefined main extension direction. The ring 21 is accommodated with clearance through the connection opening 310, thus allowing a movement of the ballast element 3 with respect to the ring 21, preferably a movement of the ballast element 3 along the main extension direction of the connection opening 310.

In one embodiment, the dimension of the connection opening 310 along the main extension direction is between 5 and 20 centimeters, preferably between 7 and 15 centimeters, for example of about 10 centimeters.

In one embodiment, the connection opening 310 has an opening axis Y.

Preferably, the ballast element 3 is rotatable with respect to the ring 21 about the opening axis Y.

In one embodiment, the ring 21, for example a segment 215 of the ring 21, passes through the connection opening 310 along the opening axis Y.

In one embodiment, the opening axis Y extends tangentially to the ring 21, for example to a segment 215 of the ring 21.

In one embodiment, the ring 21, for example a segment 215 of the ring 21, extends along the opening axis Y.

In one embodiment, the ballast element 3 is slidingly engaged with the ring 21.

Preferably, the ballast element 3 is slidable along the ring 21, for example in a circumferential direction about the device axis X.

Preferably, the ballast element 3 is slidable along the segment 215 of the ring 21, with which it is engaged or constrained.

In one embodiment, the ballast element 3 is positionable in a plurality of angular positions about the device axis X.

In one embodiment, the ballast element 3 is movable in a radial direction with respect to the device axis X, for example by means of the connection created by the ring 21 passing through the connection opening 310.

In one embodiment, the annular device 2 is configurable in an assembly configuration, in which it allows the removal or addition of one or more ballast elements 3 from/to the ring 21.

The annular device 2 is preferably configurable in a working configuration, in which it prevents the removal or addition of one or more ballast elements 3 from/to the ring 21.

In one embodiment, the annular device 2 comprises reversible closing and opening means 9 associated with the ring 21, preferably associated with two segments 215 of the ring 21, to configure the annular device 2 in the assembly configuration, preferably even in the working configuration.

Preferably, the reversible closing and opening means 9 comprise a snap hook or a snap buckle, or other types of connection means which create a shape or force or snap coupling, of the reversible type.

In one embodiment, the ring 21 extends circumferentially between two ends, both of which are engaged with the reversible closing and opening means 9. In the assembly configuration, the reversible closing and opening means 9 separate the two ends of the ring 21, allowing the removal and/or addition of one or more ballast elements 3 to the ring 21.

In the working configuration, the reversible closing and opening means 9 keep the two ends of the ring 21 engaged with each other, thus preventing the separation thereof.

The ballast element 3 comprises a main portion 32 extending from the connection portion 31, mainly along the main axis Z.

The main portion 32 has a substantially linear extension with respect to the main axis Z.

In one embodiment, the main portion 32 has dimensions exceeding the dimensions of the connection portion 31. Preferably, along the main axis Z, the main portion 32 has a dimension or length which is equal to approximately twice the dimension or length of the connection portion 31.

In one embodiment, the main portion 32 extends, preferably along the main axis Z, between an initial segment 325 joined and adjacent to the connection portion 31, and an opposite final segment 329 distal from the connection portion 31.

Preferably, the final segment 329 ends with a final end 328.

In one embodiment, the final end 328 of the final segment 329 of the ballast element 3 is a free end.

In one embodiment, the final end 328 of the final segment 329 of the ballast element 3 is engaged with a handle or a knob graspable by the user, or there is a region having larger or smaller dimensions, or there is a knurled region, to facilitate the grip by the user.

In one embodiment, the main portion 32 is substantially cylindrical or conical in shape.

In one embodiment, the main portion 32 has a circular cross-section and a diameter between 1 and 15 centimeters, preferably between 2 and 10 centimeters, for example of about to 7 centimeters, for example with a substantially constant diameter. Such dimensions allow the main portion 32 to be correctly graspable for performing the physical exercises. Larger dimensions do not allow for an adequate grip, making it difficult to perform physical exercises.

In one embodiment, the ballast element 3 is made in a single piece. Preferably, the ballast element 3 is made of a single material.

In one embodiment, the ballast element 3 is made of a material belonging to the Nylon family and/or a material belonging to the polyester family.

In one embodiment, the ballast element 3 is a cord or rope, i.e., it is obtained by joining together several wires or strands, conventionally three or four in number, each of which in turn consists of a certain number of elementary threads twisted together.

In one embodiment, the ballast element 3 is made of a material belonging to the family of plastic materials.

In one embodiment, the ballast element 3 is made of rubber.

In one embodiment, the connection portion 31 consists of a head segment 315 of the main portion 32 folded on itself by approximately 180°, creating a closed path together with the remaining part of the main portion 32, in particular together with the initial segment 325, so as to peripherally define the connection opening 310.

In one embodiment, the ballast element 3 consists of a single segment, for example made of plastic or rubber or cord or rope obtained in a single piece by joining several wires or strands, having a linear extension along the main axis Z between a head segment 315 and a final segment 329, where the head segment 315 is folded on itself by approximately 180°, forming the connection portion 31 and peripherally defining the connection opening 310, where the remaining part of the segment forms the rectilinear main portion 32, having a linear extension along the main axis Z, which comprises an initial segment 325 joined and adjacent to the connection portion 31, and the final segment 329, preferably ending with a final end 328, for example a free end.

In one embodiment, the exerciser 1 further comprises an external layer of covering wires or strands which covers the main portion 32.

In one embodiment, the exerciser 1 further comprises an external layer of covering wires or strands which keeps the initial segment 325 of the main portion 32 and the head segment 315 folded on itself joined together.

In one embodiment, the exerciser 1 comprises a closing element 5 which integrally joins the initial segment 325 of the main portion 32 and the head segment 315 folded on itself by approximately 180° to form the connection portion 31.

Preferably, the closing element 5 is positioned above, i.e., outside, the external layer of covering wires or strands.

Preferably, the closing element 5 is a ring, for example made of plastic material, or it is a band which joins the initial segment 325 and the head segment 315 folded on itself.

Preferably, the closing element 5 is made of the same material as the ballast element.

In one embodiment, the exerciser 1 comprises a second closing element 5 in the final segment 329, for example close to the final end 328, for example located within 5 centimeters from the final end 328.

At least one ballast element 3 comprises a grip segment 39 manually graspable by a user to perform physical exercises.

Preferably, all the ballast elements 3 comprise a grip segment 39 manually graspable by a user to perform physical exercises.

In one embodiment, the grip segment 39 is located in the connection portion 31.

In one embodiment, the grip segment 39 is located in the main portion 32, preferably along the main axis Z, for example in a position proximal to the ring 21 or for example in a position distal from the ring 21.

In one embodiment, the grip segment 39 has a circular cross-section and a diameter between 1 and 15 centimeters, preferably between 2 and 10 centimeters, for example of about 7 centimeters. Such dimensions allow the ballast element 3 to be correctly graspable for performing the physical exercises. Larger dimensions do not allow for an adequate grip, making it difficult to perform physical exercises.

In one embodiment, the ballast element 3 comprises at least two grip segments 39.

In one embodiment, the grip segment 39 extends along the entire main portion 32.

In one embodiment, the grip segment 39 extends along the initial segment 325 of the main portion 32.

In one embodiment, the grip segment 39 extends along the final segment 329 of the main portion 32.

In one embodiment, the grip segment 39 is enclosed between the initial segment 325 and the final segment 329 of the main portion 32.

In one embodiment, the grip segment 39 extends along the connection portion 31.

In one embodiment, the grip segment 39 extends along the entire ballast element 3. In other words, the entire ballast element 3 is graspable by the user at any point.

In one embodiment, the ballast element 3 comprises two connection portions 31, independent of each other and each engaged with the ring 21, and two main portions 32 extending linearly and independently along respective main axes Z, where the two final ends 328 are mutually engaged or made in a single piece, operatively connecting the two main portions 32.

In one embodiment, the ballast element 3 is substantially "U"-shapes, is made in a single piece, and comprises two connection portions 31, independent of each other and each engaged with the ring 21, where the region folded to form the "U" identifies the final end 328 of the ballast element 3.

In one embodiment, the exerciser 1 consists of the annular device 2 and one or more ballast elements 3 constrained together by means of the annular device 2.

In one embodiment, a kit comprises an annular device 2 comprising a ring 21 having an extension about a device axis X, and at least one ballast element 3 comprising a connection opening 310 passing through a connection portion 31 of the ballast element 3, where the ring 21 is insertable into the connection opening 310 of the ballast element 3 to allow a movement of universal type of the ballast element 3 with respect to the ring 21 in the absence of user's support, where the ballast element 3 is manually graspable by a user to perform physical exercises.

In one embodiment, the exerciser comprises one or more main ballast elements 3, graspable by the user, and one or more auxiliary ballast elements 3, not configured to be comfortably graspable by the user, for example having a diameter exceeding 15 cm.

In one embodiment, a ballast element 3 is connectable to a ring 21 extending about a device axis X of an annular device 2 of an exerciser 1, where the ballast element 3 extends linearly along a main axis Z between a connection portion 31 and a final end 328 distal from the device axis X, where the ballast element 3 is connectable to the ring 21 by means of the connection portion 31, so as to allow a movement of universal type of the ballast element 3 with respect to the ring 21, in the absence of the user's support.

Innovatively, the graspable exerciser according to the present invention meets the needs of the field, since it allows performing a wide range of exercises for muscle training.

Advantageously, the exerciser is multidisciplinary and multifunctional.

Advantageously, the exerciser allows the user to choose the number and mass of the ballast elements, according to his/her training needs. Advantageously, the exerciser is usable by all types of users, from beginners to experienced, i.e., it is customizable based on the user's profile.

Advantageously, the exerciser is easily and conveniently grippable, graspable and manageable by the user, thus making the exercises easier to perform.

Advantageously, the exerciser allows performing specific exercises for training the forearms, for example by appropriately sizing the ballast element.

Advantageously, the exerciser allows training the entire body, since it is usable as an overload factor and as a grip when performing a wide range of exercises. By way of non-limiting example, the exerciser is graspable to perform biceps curls, military presses, French presses, and diagonal wall twists. By way of non-limiting example, the exerciser is graspable and positionable on the shoulders and/or back to perform deadlifts, Romanian deadlifts, squats, sumo squats, static or walking lunges. By way of non-limiting example, the exerciser is usable as an overload in bar exercises such as pull ups or is usable for long-distance throws while stationary or in motion or is wearable on the body or parts of the body of the user.

Advantageously, the exerciser is graspable and positionable in a multitude of positions and orientations, since it adapts to the action of the force of gravity, of the grip by the user, and of the trajectory imparted when thereto. Advantageously, performing physical exercises, the exerciser allows taking advantage of the mass and inertia of the moving, for example rotating, ballast elements, offering a different type of work, therefore varying the training for the user.

Advantageously, the exerciser is easy and intuitive to use for training.

Advantageously, the exerciser is easy and intuitive to assemble and disassemble.

Advantageously, the exerciser is easily transportable and is not bulky.

Advantageously, the exerciser obviates the problems of scratches on floors or walls since it is made of scratchproof materials.

Advantageously, the exerciser is cost-effective and affordable to produce.

Advantageously, the exerciser is modular and assemblable as a function of the needs of the user and the type of physical exercise to be performed.

In order to meet contingent needs, it is apparent that those skilled in the art may make changes to the invention described above, all contained within the scope of protection as defined in the following claims.

What is claimed is:

1. An exerciser graspable by a user for performing a physical exercise, the exerciser comprising:

an annular device comprising a ring extending about a device axis; and a plurality of ballast elements, wherein each ballast element extends linearly along a main axis thereof between a connection portion and a final end distal from the device axis;

wherein each ballast element is freely connected to the ring by the connection portion, allowing the ballast element to freely perform relative movements with respect to the ring, even without an intervention of the user; and wherein each ballast element has a predefined mass between 1 and 10 kilograms.

2. The exerciser of claim 1, further comprising a connection opening, wherein the ring extends through the connection opening of the ballast element, and wherein the ring is accommodated with clearance through the connection opening, thus allowing the relative movements of the ballast element with respect to the ring.

3. The exerciser of claim 2, wherein the connection opening has an opening axis, and wherein the ballast element is rotatable with respect to the ring about the opening axis.

4. The exerciser of claim 2, wherein the ballast element is made in a single piece.

5. The exerciser of claim 4, wherein the connection portion consists of a head segment folded on itself by approximately 180°, creating a closed path which peripherally defines the connection opening.

6. The exerciser of claim 1, wherein the ballast element is slidingly engaged along the ring and positionable in a plurality of angular positions about the device axis.

7. The exerciser of claim 1, wherein the ballast element is made of rope or cord, a material belonging to a family comprising nylon, and/or a material belonging to a family comprising polyester.

8. The exerciser of claim 1, wherein the ring is made of rope or cord, a material belonging to a family comprising nylon, and/or a material belonging to a family comprising polyester.

9. The exerciser of claim 1, wherein the ballast element comprises a main portion mainly extending along the main axis, having a circular cross-section and a diameter between 1 and 15 centimeters so as to be graspable and make it easier to perform the physical exercise.

10. The exerciser of claim 9, wherein the main portion ends with a final segment opposite to the connection portion along the main axis, and wherein the exerciser further comprises a handle or a knob graspable at the final end of the final segment.

11. The exerciser of claim 9, wherein the main portion has a diameter between 2 and 10 centimeters.

12. The exerciser of claim 1, wherein the annular device comprises reversible closing and opening means associated with the ring and configurable in an assembly configuration, in which the annular device allows removal and/or addition of one or more ballast elements to the ring.

13. The exerciser of claim 1, wherein the ballast element consists of a single segment having a linear extension along the main axis between a head segment and a final segment, wherein the head segment is folded on itself by approximately 180°, and is blocked to form the connection portion, peripherally defining a connection opening of the connection portion, through which the ring passes, and wherein a remaining segment of the single segment forms a main portion which extends linearly from an initial linear segment, joined to the head segment, up to the final segment.

* * * * *